United States Patent [19]

Dobo

[11] 4,104,445

[45] Aug. 1, 1978

[54] METHOD FOR MAKING STEEL WIRE

[75] Inventor: Emerick J. Dobo, Cary, N.C.

[73] Assignee: Monsanto Company, St. Louis, Mo.

[21] Appl. No.: 624,076

[22] Filed: Oct. 20, 1975

[51] Int. Cl.[2] ..... B22F 3/00; B22F 1/00

[52] U.S. Cl. ..... 428/567; 75/207; 75/DIG. 1; 75/229; 428/602; 428/568; 428/577; 428/539.5

[58] Field of Search ..... 75/207, DIG. 1, 211, 75/229, 539.5; 428/602, 567, 568, 577

[56] References Cited

U.S. PATENT DOCUMENTS

| | | | |
|---|---|---|---|
| 3,529,044 | 9/1970 | Santangelo | 264/29 |
| 3,671,228 | 6/1972 | McIntire et al. | 75/214 |
| 3,697,262 | 10/1972 | Fenner | 75/207 |

FOREIGN PATENT DOCUMENTS

| | | | |
|---|---|---|---|
| 45-28692 | 9/1970 | Japan | 75/207 |

*Primary Examiner*—Brooks H. Hunt

*Attorney, Agent, or Firm*—Howard C. Stanley; James W. Williams, Jr.; Russell E. Weinkauf

[57] ABSTRACT

A method for making filamentary steel wire from particulate iron oxides with the aid of a fiber-forming acrylic polymer is disclosed. A precursor filament is first formed by wet-spinning an acrylic polymer spin dope in which particles of iron oxide are dispersed. The resulting precursor filament is then exposed to a reducing atmosphere (e.g., a gaseous mixture of hydrogen and carbon monoxide) at a temperature in the range of from about 900° C. to 1150° C. for a period of about 3 to 8 minutes. Under these conditions, the iron oxide particles are reduced to the metallic state and the polymer in the precursor is pyrolized to carbon and byproduct gases. The carbon diffuses into the resulting metallic iron, and the individual metal particles sinter to form continuous steel wire.

The method has the capability of producing steel wire of an essentially ferritic/pearlitic structure with a tensile property in excess of 140,000 psi. When the product is converted to a tempered martensite structure tensile strengths exceeding 260,000 psi are achievable.

12 Claims, 2 Drawing Figures

METHOD FOR MAKING STEEL WIRE

BACKGROUND OF THE INVENTION

The invention is directed to the fabrication of steel wire of various types by a method which is capable of producing a quality product at high rates of productivity. The method, which is a complete departure from conventional practice, has particular significance when used in the manufacture of filamentary steel wire of very fine diameter, for example, in the range of from about 0.5 to 20 mils.

Although the conventional practice for manufacturing steel wire is capable of producing a high quality product, the need for casting, repeated mechanical reductions, intervening heat treatments and other required operations render the resulting wire product relatively expensive. This becomes apparent when one considers the steps involved merely to obtain the intermediate steel wire rod product. That is, molten steel is cast into ingots which are subsequently rolled into blooms from which billets are formed. Finally, the billet is hot rolled to produce the steel wire rod. The wire rod must then undergo a series of elaborate and costly metal-drawing and heat treating operations to obtain a steel wire product of the desired cross-section and mechanical properties.

It is, of course, obvious that the smaller the diameter of the wire produced by the afore-mentioned processing procedures, the greater will be cost of production. Yet, there has been an increasing demand for wire having diameters in the range of 10 mils or less, and in some applications less than 5 mils is desired. This demand has come about largely as a result of the growing use of filamentary steel wire as a reinforcing element in composite materials. For example, fine diameter steel is now widely used to reinforce the rubber carcass of pneumatic tires. The steel tire cord employed for this purpose is generally made from high carbon steel, i.e., from 0.6 to 0.8 percent by weight of carbon. Because of the relatively low product yield, wire drawing of such high carbon material to attain fine diameters becomes excessively expensive. Moreover, because of the loss of ductility resulting from the need to pull the wire through numerous drawing dies, frequent intermediate heat treating steps are needed to restore the ductility required for further drawing.

There is, therefore, a desire and a need for an alternative to the conventional practice for producing steel wire wherein a product of substantially equivalent properties can be produced at considerably less cost.

A number of previous attempts have been made to meet this need, but for one reason or another the methods proposed have not proved to be entirely successful in practice. Perhaps, most noteworthy of the prior proposals is a method wherein certain techniques of the ceramic arts are utilized. Such method is described in U.S. Pat. No. 3,671,228 and involves a procedure wherein a powdered agglomerate of iron oxide is mixed with a binder and the mixture is placed in a die chamber where it is compacted and extruded with a hydraulic press to form filaments. The filaments are then subjected to a reducing atmosphere at a temperature below the sintering temperature to effect reduction of the metal oxide to the metallic state followed by a sintering of the reduced compact to form wire.

Although this prior method constitutes a significant advance in the art, the brittleness of the precursor filaments makes further handling in the conversion operations difficult. Moreover, the high pressures required to form the precursor add to processing costs.

It is, therefore, an object of this invention to provide an entirely new approach to the production of filamentary wire.

It is further object of this invention to provide a method for producing filamentary steel wire which is substantially less costly than the conventional practice.

It is a still further object of this invention to provide a method for producing steel wire products which have outstanding mechanical properties.

SUMMARY OF THE INVENTION

In carrying out the process, a precursor filament consisting of an acrylic polymer with particles of iron oxide entrained therein is first formed. This is accomplished by employing wet-spinning techniques such as are commonly used in the textile arts for the production of acrylic fibers. That is, a spinning dope is made up consisting of a uniform dispersion of iron oxide particles in an acrylic polymer solution with the ratio by weight of iron oxide to acrylic polymer being in the range of about 3:1 to 7:1. The iron oxide containing acrylic polymer spin dope is then spun through a spinnerette and directly into a coagulation bath to form the precursor filament. The filamentary precursor is converted to steel wire by exposing the filament to a reducing atmosphere (e.g., a gaseous mixture of hydrogen and carbon monoxide) for a period ranging between about 3 to 8 minutes at a temperature in the range of from about 900° C. to 1150° C. Under these conditions, the iron oxide particles are reduced to the metal state, and the polymer in the precursor is pyrolized to carbon and by-product gases. The carbon is absorbed by the metallic iron, and the individual metal particles are caused to sinter to form continuous steel wire.

Optionally, the precursor filament may be drawn or stretched following the formation thereof to improve its tenacity for further handling. Also, the toughness of the precursor may be improved by a shrinking operation which can be conducted immediately subsequent to the drawing procedure. In addition, the tensile properties of the ultimate steel wire product can be enhanced by a conventional heating and quenching treatment to produce a tempered martensitic structure. It is also within the purview of the invention to combine other reducible metal compounds in particulate form together with the iron oxide particles when making up the spin dope in order to produce steel alloy wire.

DESCRIPTION OF THE INVENTION

In the context of this invention, the term "acrylic polymer" refers to a fiber-forming polymer and includes polyacrylonitrile and copolymers and terpolymers of acrylonitrile. That is, those copolymers and terpolymers are included which are obtained by polymerizing acrylonitrile with monomers such as vinyl acetate, methyl acrylate, vinyl pyridine and others which are known by those skilled in the art to be polymerizable with acrylonitrile to give satisfactory fibers and filaments.

As used herein, the term "iron oxide" is intended to include both hematite ($Fe_2O_3$) and magnetite ($Fe_3O_4$) or mixtures thereof.

Also, in the context of this invention the term "filamentary steel wire" has reference to an elongated structure which may be either circular or rectangular in cross-section. When rectangular, the structure has a ribbon configuration with the aspect ratio of thickness to width being generally in the range of about 1:20. The elongated structures of circular cross-section generally have diameters in the range of from about 0.5 to 20 mils and may be solid or hollow. In the latter case, a thin wall tubing is provided.

As indicated, the iron oxides suitable for the purposes of this invention consist of either hematite ($Fe_2O_3$) or magnetite ($Fe_3O_4$) or mixtures of the two. The iron oxide needs to be in particulate form and in order to achieve the density desired in the ultimate wire product the metal particles should possess a good distribution in particle size. However, the average diameter of the particles should not exceed about 5 microns, with an average diameter of about 1 micron or less being usually preferred.

An excellent source of hematite is the by-product obtained in the regeneration of hydrochloric acid pickling solutions which are used in the iron and steel industry to remove mill scale and other forms of iron oxide from iron and steel products. The procedure includes a reaction chamber which converts the ferrous chloride to ferric oxide and regenerates hydrogen chloride gas. The regenerated hydrogen chloride gas is absorbed in water and the hydrochloric acid obtained is recycled to the pickling bath. The hematite recovered as by-product is in the form of small particles caused by the turbulence of the hot gases in the reaction chamber.

Another source of suitable iron oxides is the high grade iron ore concentrates (more than 95 percent by weight of iron oxide) which are available in various parts of the world. An example is the MAC Maimberget A concentrate ore from Sweden which contains over 98 percent by weight of iron oxide (i.e., 96.23 percent magnetite and 2.24 percent hematite).

For convenience, the invention will now be described in terms of its utilization in the production of steel wire, although as previously noted, the method is also applicable in the production of steel alloy wire.

In making up the spin dope from which the precursor filaments are produced, the iron oxide particles are incorporated into a typical acrylic polymer spinning solution in the form of a uniform dispersion. The solvent may be selected from those commonly used in the wet-spinning of acrylic polymers (e.g. dimethylacetamide, dimethylformamide and dimethylsulfoxide) with the ratio by weight of solvent to polymer being in the range of from 3.5:1 to 6:1, and preferably 3.8:1 to 4.5:1, respectively. The iron oxide particles are added in an amount such that the ratio by weight of metal oxide to acrylic polymer is in the range of about 3:1 to 7:1, respectively. Although not required, it is sometimes advantageous to add small amounts of a wetting agent to the dope (e.g., less than 1.0 percent by weight of sorbitan monopalmitate). Following make-up, the dope components are mixed by well known methods to solubilize the polymer and to obtain a uniform dispersion of the metal oxide.

Filamentary structures are formed from the afore-described spin dope by continuously extruding the dope through a desired number of shaped orifices in a spinnerette and directly into a coagulation bath. The pressures required to give satisfactory extrusion rates are nominal and generally do not exceed 50 psig, with the normal range being from about 10 to 50 psig. The orifice design will, of course, determine the configuration of the filament. Aside from the standard filament of circular cross-section produced by a round orifice, a rectangular slit will produce a filament having a ribbon configuration.

Also, many orifice designs are known in the art for producing a hollow or tubular filamentary structure such as, for example, a segmented arc configuration, plug-in-orifice and others such as disclosed in U.S. Pat. No. 3,405,424.

As is typical in the wet-spinning of acrylic fibers, the coagulation bath contains both a precipitant and a solvent for the acrylic polymer. The precipitant or coagulant is generally either water or ethylene glycol. And although a wide variety of solvents are applicable, solvents such as dimethylacetamide, dimethylformamide and dimethylsulfoxide are generally of preference both in conventional acrylic fiber spinning and in the practice of this invention. For convenience, it is usually desirable to employ the same solvent as was used in preparing the spinning dope.

For the purposes of this invention a binary mixture of water and dimethylacetamide or ethylene glycol and dimethylacetamide is usually preferred. When employing the former the solvent is generally present in the range of from about 30 to 70 percent by volume, with from 50 to 60 percent being preferred. When employing ethylene glycol as the coagulant in lieu of water, the dimethylacetamide solvent generally constitutes from about 15 to 85 percent by volume of the mixture, with from about 40 to 60 percent being preferred.

With water/dimethylacetamide systems the bath temperatures are those conventionally employed and can range between 28° C. and 70° C., with from about 35° C. to 60° C. being preferred. In the case of ethylene glycol/dimethylacetamide mixtures, the bath temperature may range between 0° C. to 95° C., with 10° C. to 30° C. being usually preferred. An especially preferred coagulation system is one comprised of a mixture of ethylene glycol and a dimethylacetamide solvent, with the solvent constituting from about 40 to 60 percent by volume of the mixture. In operation, the coagulating bath containing these components is preferably maintained at a temperature in the range of from about 10° C. to 30° C.

In some instances, it may be desirable to add an acrylic plasticizer (e.g., N, N-dimethyl lauramide) to the coagulation bath. When used, this optional ingredient is generally present in an amount not exceeding 0.1 percent by weight of the coagulation composition.

Although acceptable precursor filaments are produced following the afore-mentioned filament-forming operations, improvements can be imparted by an additional stretching or attenuation step. That is, the coagulation step may be followed by a polymer orientation step in which the filaments are stretched from about 1 to 3 times their initial length in a conventional hot water or boiling water stretch bath. This orientation and attenuation procedure, which greatly improves filament strength and productivity, is generally referred to as a "hot cascade" stretch. Stretching is accomplished by correlating the linear entry rate of the filaments into the stretch bath with the rate of withdrawal. When the latter is at a higher rate, stretching of the filament will, of course, occur.

Although again optional, further advantages can be realized by following the stretch operation with a shrinking step. This is also accomplished by continuously passing the filaments through a hot or boiling water bath. However, in contrast to the stretching procedure, the filaments are withdrawn from the bath at a speed sufficiently slower than the feed speed to allow relaxation and shrinkage to occur. The extent of shrinkage is usually much less than the stretch originally imparted. In general, the ratio of the length of the filaments before and after shrinking is in the range of from about 1:0.9 to 1:0.7, respectively. The purpose of this processing step is to improve the toughness of the precursor filaments and to minimize the extent of shrinking which occurs when converting the precursor to steel wire.

Conversion of the precursor filaments to steel wire is effected by exposing the filaments to a reducing atmosphere at a temperature in the range of from about 900° C. to 1150° C. over a time span of from about 3 to 8 minutes. Under these conditions, the iron oxide particles are reduced to iron, the polymer in the precursor is converted to carbon and by-product gases with the carbon being absorbed by the iron, and the individual metal particles sinter to form continuous steel wire.

It has been found that good results are achieved when the reducing atmosphere is comprised of a gaseous mixture consisting of about 80 to 98 percent by volume of hydrogen, from 2 to 15 percent by volume of carbon monoxide and from 0 to 10 percent by volume of a carburizing gas. In addition to contributing to the reduction of iron oxide to iron, the carbon monoxide serves to control the absorption of carbon into the iron. An especially efficient reduction is realized when the hydrogen component of the reducing atmosphere contains a mixture of both atomic and molecular hydrogen. That is, atomic hydrogen will diffuse more readily into the interstices of the metal oxides than will molecular hydrogen because of its smaller size and weight. This faster diffusion rate will, of course, facilitate reduction. In addition, the presence of atomic hydrogen increases the inherent reduction power of the system. A carburizing medium may be included in the reducing gas mixture, if desired, to provide an additional source of carbon to further enhance the tensile strength of the ultimate steel wire product. When used, the carburizing gas may be selected from the hydrocarbon gases commonly used in the steel industry as a carburizing medium to supply a quantity of carbon for absorption and diffusion into steel. Included among such gases are methane, ethane, propane and butane, with methane and propane being especially preferred.

In a preferred mode for carrying out the precursor conversion step of the process, the precursor filaments are continuously processed through an elongated furnace which has been heated to an appropriate temperature. The reducing gases are caused to flow within the furnace in a reverse direction to the direction of movement of the wire being formed. In this manner the wire never "sees" an oxidizing environment until the process is complete and the wire exits the furnace to a take-up device.

In addition to effecting a reduction, the reducing gases cool the moving wire at the point of contact therewith to produce a pearlite structure of relatively fine grain structure. The tensile properties of the resulting steel wire product may be improved by conversion to a tempered martensite structure. This can be accomplished by well-known methods which involve heating to a relatively high temperature, quenching and then reheating to a lower temperature. For example, the steel wire may be heated continuously in a furnace to the austenitic temperature and then quenched in oil or water. This is followed by a post-tempering in oil.

Attention is now directed to the attached drawing which illustrates the types of apparatus which may be employed in carrying out the method of this invention.

Figure 1:
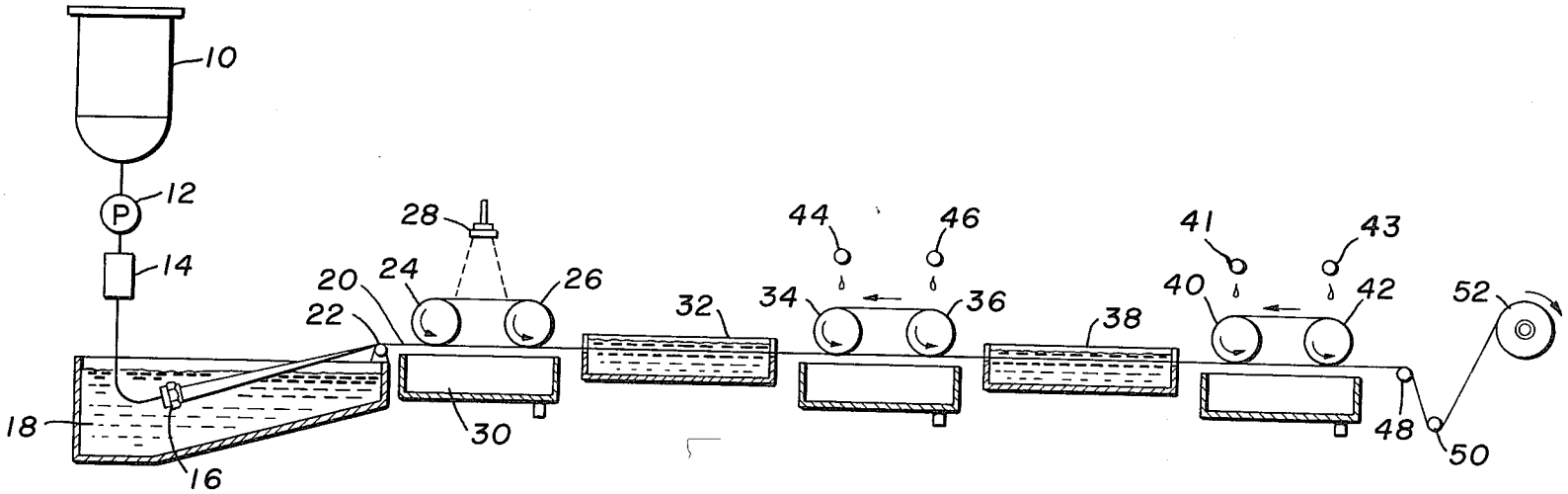
FIG. 1 is a side elevational view partly in section showing an apparatus arrangement of the type which can be used to form the precursor filaments.

Referring now to FIG 1, a spin dope consisting of an acrylic polymer solution with iron oxide particles uniformly dispersed therein is pumped from supply tank 10 by pumping means 12 through filter 14 and thence to spinnerette assembly 16. The dope is extruded through the filament shaping orifices of the spinnerette and passes directly into coagulation bath 18 where the filaments are formed. From the coagulation bath the filaments are withdrawn over guide means 22 by positively driven filament advancing rolls 24 and 26. When on these rolls, the filaments are water washed to complete the coagulation and to remove residual solvent. The water is supplied from a spray or shower head 28, with the wash water being collected in a container or tray 30. It will be recognized that the washing operation can be conducted in more than one stage of the process and by the employment of other known washing means. After leaving rollers 24 and 26, the filaments are directed into a "hot cascade" bath 32 which contains hot or boiling water. The filaments are withdrawn therefrom by means of driven rollers 34 and 36, which are operated at a peripheral speed greater than that of rolls 24 and 26 so that the filaments are caused to stretch during passage through hot water bath 32. After leaving rollers 34 and 36, the filaments are directed into a second hot or boiling water bath 38. They are withdrawn from bath 38 by means of rolls 40 and 42 which are driven at a peripheral speed less than that of rolls 34 and 36 so that the filaments are permitted to relax and thereby shrink during passage through the bath. In order to keep the filaments moist and thereby faciliate processing, water is dripped on rolls 34 and 36 through pipes 44 and 46. Likewise water is dripped onto rolls 40 and 42 through pipes 41 and 43. From rolls 40 and 42 the filaments are passed over guides 48 and 50 and onto take-up device 52.

Figure 2:
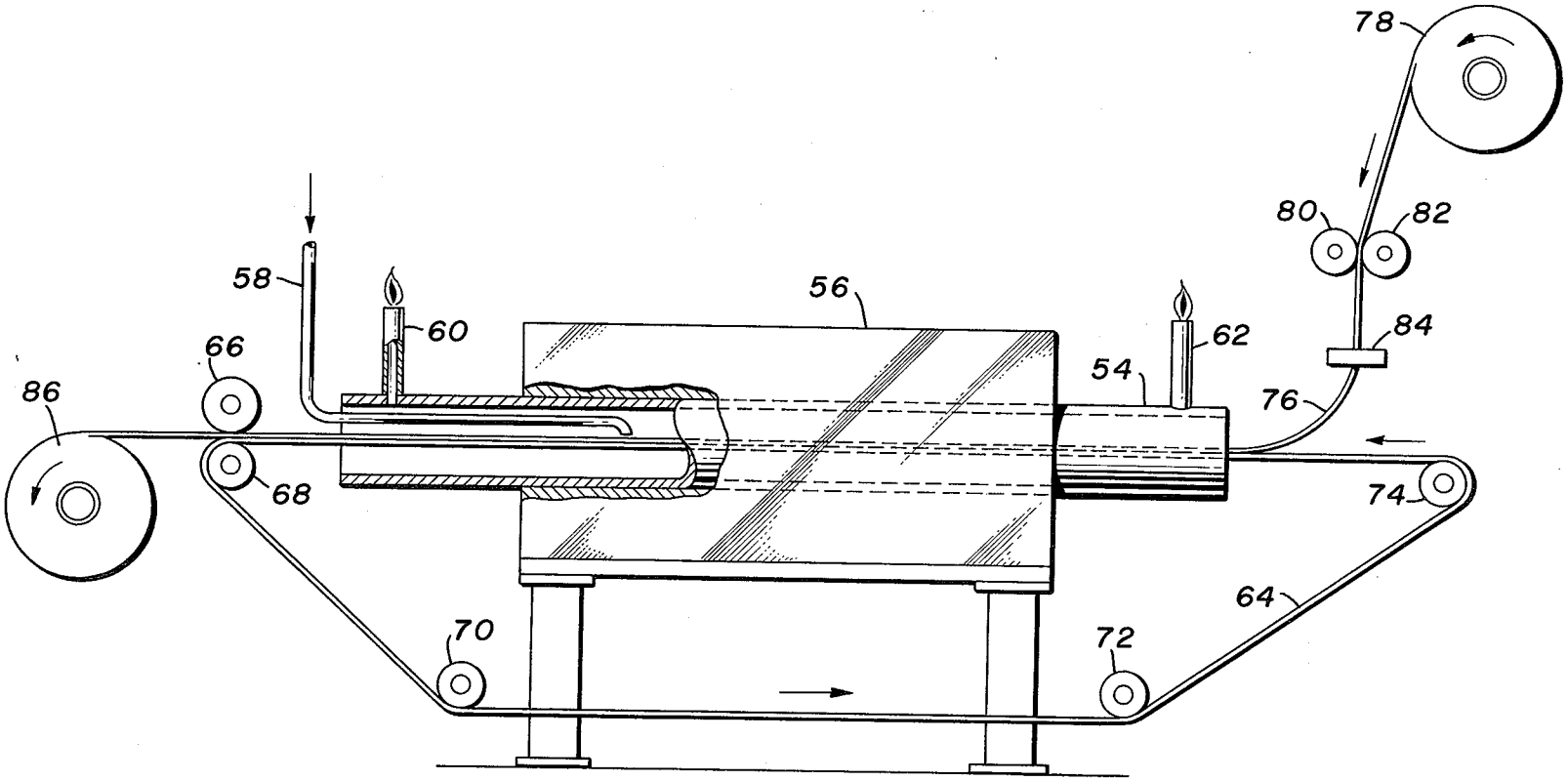
FIG. 2 is a schematic side elevational view partly in section illustrating a furnace arrangement suitable for use in converting the precursor filaments to steel wire.

Referring now to FIG. 2 which illustrates a type apparatus which may be used to convert the precursor filaments to steel wire. An elongated heating chamber 54 is shown having its mid-section encased in an insulated housing member 56 in which resistance heating elements (not shown) are embedded. A gas inlet tube 58 for introducing reducing gases is inserted into one end of the elongated heating chamber 54 and flare tubes 60 and 62 for gas burn-off are provided at each of the opposing ends of the chamber. An endless steel belt 64, is provided for carrying the filaments being processed through heating chamber 54 in a direction opposite to the flow of gas entering the system from gas inlet tube 58. Upon exiting the heating chamber the steel wire obtained passes through the nip of spring loaded tension rolls 66 and 68 and onto a take-up device 86.

To further supplement the description of this invention, the following illustrative Examples are presented.

EXAMPLE 1

This example illustrates a run in which the iron oxide particles employed consisted of hematite ($Fe_2O_3$).

A solvent mix, consisting of 850 cc of dimethylacetamide, 0.5 cc of ethylene glycol, and 1.2 cc of sorbitan monopalmitate, was intimately mixed with 1000 grams of hematite in a rod mill for 10 hours. The resulting slurry was then transferred to a large Waring blender where it was chilled to a temperature of 5° C. after which a copolymer consisting of 93 percent by weight of acrylonitrile and 7 percent by weight of vinyl acetate was added. The solvent was chilled to reduce its solvency so that the polymer could be dispersed mechanically with only small amounts going into solution. The Waring blender was then brought to high speed and further blending of the oxide and complete solution of the polymer took place. The blender was turned off when a final temperature of 42.5° C. was obtained as sensed by a thermocouple in the mixture. The heat for the temperature rise resulted from the degradation of mechanical energy supplied by the blending device. During the mixing period, a vacuum of 22 inches of mercury was pulled on the contents of the blender to reduce the amount of air entrapment in the precursor mix.

The contents of the blender were transferred to the dope pot of a wet-spinning line where the precursor mix was subjected to a vacuum of 22 inches of mercury for ½ hour and then pressurized to 35 psi. for ¼ of an hour. This step was undertaken to again reduce entrained air that could cause voids in the precursor filaments. A positive displacement pump was used to deliver 14.6 cc per minute of the precursor dope through a filter stack having a final stainless steel screen of 120 mesh and then through a cup spinnerette which had five holes each of 20 mils in diameter. Upon emerging from the spinnerette, the dope threadlines entered a coagulation bath which was at a temperature of 24° C. The coagulation system employed consisted of a mixture of 50.2 percent by volume of ethylene glycol and 49.8 percent by volume of dimethylacetamide. An acrylic plasticizer (N,N-dimethyl lauramide) was also present in an amount of 0.1 percent by weight based on the weight of the coagulating mixture. The threadline was taken up at the first godet (thread advancing rolls) at 20 feet per minute and washed with the bath solution to continue the gentle coagulation process. The second godet received the threadline at the rate of 20 feet per minute. Here the threadline was washed with water to complete the coagulation. Then the precursor threadline was stretched in boiling water, to orient the fibers. This step occurred between the second godet and the third godet which moved at a rate of 50 feet per minute. Relaxation of the threadline occurred in boiling water between the third and fourth godet which rotated at the rate of 40 rpm. On leaving the fourth godet the precursor threadline was taken up on a Leesona winder.

The take-up bobbin from the spinning line was placed in the feed position of a furnace-conversion system, and a threadline was fed at a rate of approximately 17 inches per minute into the furnace on a belt moving at a rate of 7.5 inches per minute. The precursor filaments remained in the furnace for 3.2 minutes at a temperature of 1070° C. The difference in the rates of movement between the belt and the precursor feed takes into account the shrinkage of the threadline which occurs during the conversion operation. To coordinate the feed rate of the threadline with the belt movement, the threadline position before entering the furnace was sensed by a photoelectric relay. A mixture of reducing gases was fed into the furnace near its exiting end at a rate of 15 liters per minute. The composition of this gas mixture consisted of 92.0 percent by volume of hydrogen, 4.6 percent by volume of methane, and 3.4 percent by volume of carbon monoxide. The steel wire product obtained was of an essentially ferritic-pearlitic structure with a carbon content of 0.70 percent ± 0.10 percent. Instron measurements gave a tensile strength of 122,000 psi. at a 3.4 percent elongation.

To convert into a tempered martensite, the wire was heated continuously in a furnace to 830° C. and then quenched in water to give a martensitic structure. Post-tempering to 250° C. in oil for 5 minutes gave a tempered-martensitic structure having a tensile strength of 215,000 psi.

EXAMPLE 2

This example describes a run wherein the metal oxide employed consisted of a mixture of hematite ($Fe_2O_3$) and magnetite ($Fe_3O_4$).

Five hundred grams of hematite, 500 grams of magnetite, and 250 grams of a copolymer consisting of 93 percent acrylonitrile and 7 percent vinyl acetate were intimately mixed in a rod mill for 10 hours. A solvent mix consisting of 850 cc of dimethylacetamide and 0.5 cc of ethylene glycol was chilled to 10° C. and placed into a large Waring blender. The mixture of oxides and polymer was then transferred to the blender and stirred-in by hand to give a reasonably uniform mixture. The solvent was chilled to 10° C. to reduce its solvency and allow the polymer to be dispersed mechanically with only small amounts going into solution. The Waring blender was then brought to high speed and further blending of the oxide and complete solution of the polymer took place. The blender was turned off when a final temperature of 42.5° C. was attained as sensed by a thermocouple in the mixture. The heat for the temperature rise resulted from the degradation of mechanical energy supplied to effect mixing. During the mixing period, a vacuum of 22 inches of mercury was pulled on the contents of the blender to reduce the amount of air entrapment into the precursor mix.

The contents of the blender were transferred to the dope pot of a filament spinning line. Here the precursor mix was subjected to a vacuum of 22 inches of mercury for one-half hour and then pressurized to 35 psi. for ¼ of an hour. This step was undertaken to again reduce entrained air that might cause voids in the precursor fiber. A positive displacement pump was used to deliver 14.6 cc per minute of the precursor dope. The dope was first passed through a filter stack having a final stainless steel screen of 120 mesh and then entered a cup spinnerette which had five holes each of 20 mils in diameter. Upon emerging from the spinnerette, the dope threadlines entered a coagulation bath which was at a temperature of 24° C. The coagulation system employed consisted of a mixture of 50.2 percent by volume of ethylene glycol and 49.8 percent by volume of dimethylacetamide. An acrylic plasticizer (N,N-dimethyl lauramide) was also present in an amount of 0.1 percent by weight based on the weight of the coagulating mixture. The threadline was taken up at the first godet at 20 feet per minute and washed with the bath solution to continue the gentle coagulation process. The second godet received the threadline at the rate of 20 feet per minute. Here the threadline was washed with water to complete the coagulation. The precursor filaments were then stretched in boiling water. This step occurred between the second godet and the third godet which rotated at a rate of 50 feet per minute. Relaxation of the threadline occurred in a boiling water bath between the third and fourth godet which rotated at the rate of 40 feet per minute. On leaving the fourth godet the precursor threadline was taken up on a Leesona winder.

The bobbin from the spinning line was placed in the feed position of a furnace conversion system. A threadline from the bobbin was fed at a rate of approximately 13 inches per minute into the furnace on a belt moving at a rate of 5.0 inches per minute. The precursor filaments remained in the furnace for 4.8 minutes, with the furnace being at a temperature of 1100° C. The difference in the rate of movement between the belt and the precursor feed accounts for the shrinkage of the threadline during the conversion operation. To coordinate the feed rate with the belt movement, the position of the threadline before entering the furnace is sensed by a photoelectric relay. The reducing gases were fed into the furnace near the exit end at a rate of 15.6 liters per minute. The composition consisted of 88.2 percent by volume of hydrogen, 6.7 percent by volume of methane, and 5.1 percent by volume of carbon monoxide. The steel wire product obtained was of an essentially pearliticferritic structure with a carbon content of 0.70 percent ± 0.10 percent. Instron measurements gave a tensile strength of 142,000 psi. at a 3.9 percent elongation.

To convert into a tempered martensite, the wire was heated continuously in a furnace to 830° C. and then quenched in oil at 100° C. to give a martensitic structure. Post-tempering to 280° C. in oil for 5 minutes gave a tempered-martensitic structure having a tensile of 265,000 psi and an elongation of 1.6 percent.

As shown by the above examples, the method of this invention is capable of producing steel wire with outstanding tensile properties. That is, steel wire of an essentially ferritic-pearlitic structure and a carbon content in the range of from 0.6 to 0.8 by weight can be produced with tensile properties exceeding 140,000 psi, and when converted to tempered martensite, tensile properties substantially in excess of 260,000 psi are attainable (see Example 2). In addition, proportionally high densities are realized. That is, products exhibiting a density of between 97.6 percent and 98.6 percent of that which is theoretically possible have been produced routinely.

Although the invention has been described with particular reference to steel wire, the method may also be employed to produce high density, steel alloy wire. This is readily accomplished by merely combining one or more other metal oxides with iron oxide when making up the spin dope used to form the precursor filament. Such spin dope will then contain a mixture of metal oxide particles dispersed in an acrylic polymer solution, with the particles having an average diameter of less than about 5 microns and the weight ratio of combined metal oxide to acrylic polymer being in the range of from 3:1 to 7:1. Any metal oxide may be used in combination with iron oxide so long as the range of conditions by which it may be reduced and sintered overlap with those of iron oxide. Among others, nickel oxide and cobalt oxide are exemplary of compounds which may be suitably combined with iron oxide to produce alloyed steel wire. The proportions of the various metal oxides can be widely varied according to the properties desired in the ultimate product.

Although the invention has been described with respect to details of the preferred embodiments, many modifications and variations which clearly fall within the scope of the invention as defined by the following claims will become apparent to those skilled in the art.

I claim:

1. A method for producing filamentary steel wire wherein particles of iron oxide are combined with a fiber-forming acrylic polymer to first form a precursor filament which is then converted to steel wire, said method comprising the following steps in sequence:

(A) providing a spinning dope wherein particles of iron oxide having an average diameter of about 5 microns or less are uniformly dispersed within a solution of acrylic polymer with the weight ratio of iron oxide to acrylic polymer being within the range of from about 3:1 to 7:1 respectively;

(B) forming a precursor filament by extruding said dope through a spinnerette and into a coagulation bath; and (C) converting said precursor filament to filamentary steel wire by subjecting the filament to a temperature in the range of from 900° C. to 1150° C. for a period of from about 3 to 8 minutes while being exposed to a gaseous atmosphere consisting of from about 80 to 94 percent by volume of hydrogen, from about 2 to 15 percent by volume of carbon monoxide and from 0 to 10 percent by volume of a gaseous hydrocarbon.

2. The method in accordance with claim 1, wherein said iron oxide is selected from the group consisting of hematite, magnetite or mixtures of hematite and magnetite.

3. The method in accordance with claim 1, wherein said acrylic polymer is a copolymer consisting of 93 percent by weight of acrylonitrile and 7 percent by weight of vinyl acetate.

4. The method in accordance with claim 1, wherein the solvent in said solution of acrylic polymer is dimethylacetamide.

5. The method in accordance with claim 1, wherein said coagulation bath consists essentially of 40 to 60 percent by volume of ethylene glycol and 40 to 60 percent by volume of dimethylacetamide.

6. The method in accordance with claim 1, wherein the hydrogen in said reducing atmosphere is a mixture of molecular and atomic hydrogen.

7. A method for producing filamentary steel wire wherein particles of iron oxide are combined with a fiber-forming acrylic polymer to first form a precursor filament which is then converted to steel wire, said method comprising the following steps in sequence:

(A) providing a spinning dope wherein particles of iron oxide having an average diameter of about 5 microns or less are uniformly dispersed in a solution of acrylic polymer with the weight ratio of iron oxide to acrylic polymer being within the range of from about 3:1 to 7:1, respectively;

(B) forming a precursor filament by extruding said dope through a spinnerette and into a coagulation bath;

(C) stretching said precursor filament from about one to three times its initial length in a boiling water bath; and (D) converting said precursor filament to filamentary steel wire by exposing the filament to a gaseous atmosphere consisting of from about 80 to 94 percent by volume of hydrogen, from about 2 to 15 percent by volume of carbon monoxide, and from 0 to 10 percent by volume of a gaseous hydrocarbon at a temperature in the range of from about 900° C.

to 1150° C. for a period of from about 3 to 8 minutes.

8. A method for producing filamentary steel wire from particles of iron oxide with the aid of a fiber-forming acrylic polymer, said method comprising the following steps in sequence:

(A) providing a spinning dope wherein particles of iron oxide having an average diameter of about 5 microns or less are uniformly dispersed in a solution of acrylic polymer with the weight ratio of iron oxide to acrylic polymer being within the range of from about 3:1 to 7:1, respectively;

(B) forming a precursor filament by extruding said dope through a spinnerette and into a coagulation bath;

(C) stretching said precursor filament from about one to three times its initial length in a boiling water bath;

(D) shrinking said precursor filament in a boiling water bath such that the ratio of its length before and after shrinking is in the range of from 1:0.9 to 1:0.7, respectively.

(E) converting said precursor filament to filamentary steel wire having an essentially ferritic-pearlitic structure by exposing the filament to a gaseous atmosphere consisting of from 80 to 94 percent by volume of hydrogen, from about 0 to 10 percent by volume of methane and from about 2 to 15 percent by volume of carbon monoxide at a temperature in the range of from about 900° C. to 1150° C. for a period of from about 3 to 8 minutes; and (F) converting the filamentary steel wire to a tempered martensite structure.

9. A synthetic filament which is convertible to filamentary steel wire when exposed to a reducing environment at temperatures in the range of from about 900° C. to 1150° C. for a period of from 3 to 8 minutes, said synthetic filament comprising a mixture of iron oxide particles and an acrylic polymer in a weight ratio of from about 3:1 to 7:1, respectively.

10. A filamentary steel wire product obtained from the reduction, carbonization and sintering of iron oxide particles which has a tensile strength of at least 140,000 psi, said steel wire product being further characterized by an essentially ferritic-pearlitic structure and a carbon content of from about 0.6 to 0.8 percent by weight.

11. A filamentary steel wire product having a carbon content in the range of from about 0.6 to 0.8 percent by weight which has been obtained from the reduction, carbonization and sintering of iron oxide particles and thereafter converted to a tempered martensite structure, said steel wire product being characterized by a tensile strength of at least 260,000 psi.

12. A method for producing filamentary steel alloy wire wherein a mixture of metal oxide particles consisting of iron oxide and one or more other metal oxides capable of being reduced and sintered at conditions effective for accomplishing a reduction and sintering of iron oxide are combined with a fiber-forming acrylic polymer to first form a precursor filament which is then converted to steel alloy wire, said method comprising the following steps in sequence:

(A) providing a spinning dope wherein said mixture of metal oxide particles having an average diameter of about 5 microns or less are uniformly dispersed within a solution of acrylic polymer with the weight ratio of iron oxide to acrylic polymer being within the range of from about 3:1 to 7:1, respectively;

(B) forming a precursor filament by extruding said dope through a spinnerette and into a coagulation bath; and (C) converting said precursor filament to filamentary steel alloy wire by exposing the filament to a gaseous atmosphere consisting of from about 80 to 94 percent by volume of hydrogen, from about 2 to 15 percent by volume of carbon monoxide, and from 0 to 10 percent by volume of a gaseous hydrocarbon at a temperature in the range of from about 900° C. to 1150° C. for a period of from about 3 to 8 minutes.

* * * * *